US010794185B2

(12) United States Patent
Komada et al.

(10) Patent No.: US 10,794,185 B2
(45) Date of Patent: Oct. 6, 2020

(54) CYLINDER BLOCK AND SWASH PLATE TYPE LIQUID-PRESSURE ROTATING APPARATUS INCLUDING SAME

(71) Applicant: KAWASAKI JUKOGYO KABUSHIKI KAISHA, Kobe-shi, Hyogo (JP)

(72) Inventors: Koichi Komada, Kobe (JP); Yuichiro Kuroda, Takasago (JP); Akihito Mitsuhata, Akashi (JP); Takaaki Sato, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/349,021

(22) PCT Filed: Nov. 9, 2017

(86) PCT No.: PCT/JP2017/040458

§ 371 (c)(1),
(2) Date: May 10, 2019

(87) PCT Pub. No.: WO2018/088487

PCT Pub. Date: May 17, 2018

(65) Prior Publication Data

US 2019/0264564 A1 Aug. 29, 2019

(30) Foreign Application Priority Data

Nov. 10, 2016 (JP) ..... 2016-219387

(51) Int. Cl.
*F01B 3/00* (2006.01)
*F01B 31/08* (2006.01)
(Continued)

(52) U.S. Cl.
CPC ..... *F01B 3/0035* (2013.01); *F01B 3/0002* (2013.01); *F01B 3/007* (2013.01);
(Continued)

(58) Field of Classification Search
CPC ..... F01B 3/0052; F01B 31/08; F04B 1/2035; F04B 53/08
See application file for complete search history.

(56) References Cited

U.S. PATENT DOCUMENTS 3,690,789 A * 9/1972 Spence ..... F01B 3/0052 417/203
3,889,578 A * 6/1975 Clerk ..... F01B 3/0052 91/499
(Continued)

FOREIGN PATENT DOCUMENTS

CN 105201816 A 12/2015
JP H10-502148 A 2/1998
(Continued)

*Primary Examiner* — Michael Leslie
(74) *Attorney, Agent, or Firm* — Oliff PLC

(57) ABSTRACT

A cylinder block includes: a plurality of cylinder bores including respective openings formed on a piston insertion end surface of the cylinder block, pistons being inserted in the respective cylinder bores and being configured to reciprocate and slide in the respective cylinder bores when the cylinder block rotates; and a cooling portion, wherein the cooling portion includes a plurality of cooling holes each formed between the adjacent cylinder bores and extending from the piston insertion end surface in an axial direction of the cylinder block.

16 Claims, 6 Drawing Sheets

(51) Int. Cl.

| | |
|---|---|
| ***F03C 1/24*** | (2006.01) |
| ***F04B 1/22*** | (2006.01) |
| ***F04B 53/08*** | (2006.01) |
| ***F04B 1/2035*** | (2020.01) |
| ***F03C 1/06*** | (2006.01) |
| ***F03C 1/40*** | (2006.01) |
| ***F04B 1/324*** | (2020.01) |
| ***F04B 1/20*** | (2020.01) |

(52) U.S. Cl.

CPC ..... *F01B 3/0052* (2013.01); *F01B 3/0076* (2013.01); *F01B 31/08* (2013.01); *F03C 1/0636* (2013.01); *F03C 1/0686* (2013.01); *F03C 1/2423* (2013.01); *F04B 1/20* (2013.01); *F04B 1/2035* (2013.01); *F04B 1/22* (2013.01); *F04B 1/324* (2013.01); *F04B 53/08* (2013.01)

(56) References Cited

U.S. PATENT DOCUMENTS

| | | | | |
|---|---|---|---|---|
| 5,971,717 | A | 10/1999 | Berthold | |
| 6,324,959 | B1 * | 12/2001 | Akasaka | F04B 1/124 92/158 |
| 7,073,427 | B2 * | 7/2006 | Donders | F01B 3/0052 91/46 |
| 2013/0000481 | A1 | 1/2013 | Ohno et al. | |

FOREIGN PATENT DOCUMENTS

| | | | |
|---|---|---|---|
| JP | 2002-267679 | A | 9/2002 |
| JP | 5444462 | B2 | 3/2014 |
| KR | 2012-0083876 | A | 7/2012 |
| WO | 2012/066593 | A1 | 5/2012 |

* cited by examiner

CYLINDER BLOCK AND SWASH PLATE TYPE LIQUID-PRESSURE ROTATING APPARATUS INCLUDING SAME

TECHNICAL FIELD

The present invention relates to a cylinder block configured such that pistons inserted in a plurality of cylinder bores formed around a rotating shaft reciprocate and slide in the cylinder bores, and a swash plate type liquid-pressure rotating apparatus including the cylinder block.

BACKGROUND ART

Various liquid-pressure apparatuses, such as hydraulic motors and hydraulic pumps, are used in industrial machines, such as construction machines. A cylinder block of such liquid-pressure apparatus includes a plurality of cylinder bores into which pistons are inserted through openings formed on a piston insertion end surface of the cylinder block. For example, when the cylinder block rotates, the pistons reciprocate and slide in the cylinder bores.

Known as this type of liquid-pressure apparatus is, for example, a swash plate type liquid-pressure apparatus disclosed in PTL 1. The swash plate type liquid-pressure apparatus (hereinafter referred to as a "swash plate type hydraulic rotating apparatus") of PTL 1 includes a rotating shaft, and a cylinder block is integrally attached to the rotating shaft. Cylinder bores are formed on an end surface of the cylinder block at regular intervals in a circumferential direction, and pistons are inserted in the respective cylinder bores. Shoes are attached to respective end portions of the pistons which portions project from the cylinder bores. The shoes are arranged on a supporting surface of a swash plate arranged in an inclined state.

According to the swash plate type hydraulic rotating apparatus configured as above, the pistons reciprocate in the cylinder bores, and this rotates the cylinder block. The pistons reciprocate by the supply of high-pressure operating oil to the cylinder bores, and this rotates the cylinder block. Then, the cylinder block rotates the rotating shaft provided integrally with the cylinder block. To be specific, the swash plate type hydraulic rotating apparatus serves as a hydraulic motor. Further, according to the swash plate type hydraulic rotating apparatus, the pistons reciprocate in the cylinder bores by the rotation of the cylinder block. By making the cylinder block rotate by the rotating shaft, the swash plate type hydraulic rotating apparatus can suck low-pressure operating oil and eject high-pressure operating oil. To be specific, the swash plate type hydraulic rotating apparatus also serves as a hydraulic pump.

Known as another conventional art is a liquid-pressure rotating apparatus configured such that detected concave portions detected by an electromagnetic pickup type rotation sensor are formed at a periphery of the cylinder block (see PTL 2).

CITATION LIST

Patent Literature

PTL 1: Japanese Patent No. 5444462

PTL 2: Japanese Laid-Open Patent Application Publication No. 2002-267679

SUMMARY OF INVENTION

Technical Problem

The swash plate type hydraulic rotating apparatuses similar in configuration to PTL 1 have been used mainly at low-speed rotation and medium-speed rotation. However, in order to deal with an increase in rotation of driving devices in construction machines and industrial machines, it is desired that the swash plate type hydraulic rotating apparatuses are configured to be usable even at high-speed rotation. When the cylinder block of the swash plate type hydraulic rotating apparatus rotates at high speed, influences of centrifugal force on the pistons and the shoes increase, and unlike the low rotation, the influences of the centrifugal force are unignorable.

For example, when the pistons reciprocate in the cylinder bores, the pistons slide on sliding surfaces of the cylinder block, and this generates heat on the sliding surfaces. The amount of heat generated on the sliding surface depends on contact pressure between the cylinder block and the piston. According to conventional low-rotation apparatuses in which the centrifugal force is extremely small, the contact pressure mainly corresponds to pressure of supplied operating oil or ejected operating oil. Therefore, the amount of heat generated on the sliding surface is relatively small. On this account, a clearance though which the operating oil is released is formed between the sliding surface and the piston, and the sliding surface is adequately cooled only by the operating oil leaking through the clearance.

However, when the cylinder block rotates at high speed, the influences of the centrifugal force on the contact pressure become more significant than the influences of the oil pressure on the contact pressure. As the rotational speed increases, the contact pressure increases, and the amount of heat generated on the sliding surface also increases. With this, the temperature of the sliding surface increases, and it becomes especially difficult to cool the sliding surface by the operating oil leaking through the clearance. Therefore, the temperature in the vicinity of the opening of the cylinder bore significantly increases. Further, when the centrifugal force increases, the piston is pushed outward, and the width of the clearance at a radially outer side of the cylinder block becomes narrower than the width of the clearance at a radially inner side of the cylinder block. In this case, the operating oil at the narrow clearance at the outer side of the cylinder block hardly flows, and therefore, the operating oil is heated at this position of the clearance. When the operating oil is continuously heated, and the temperature of the operating oil exceeds a transition temperature, lubrication performance of the operating oil deteriorates. By increasing the width of the clearance, the lubrication performance of the operating oil can be prevented from deteriorating. However, since the amount of operating oil leaking through the clearance increases by increasing the width of the clearance, the performance of the swash plate type hydraulic rotating apparatus as a pump or a motor deteriorates, and an increase in pressure of the hydraulic apparatus is limited.

In addition, a portion of the cylinder block which portion requires a cooling effect changes depending on the number of cylinder bores of the swash plate type hydraulic rotating apparatus, the rotational frequency, the usages, and the like. The cylinder block which can achieve the cooling effect depending on various swash plate type hydraulic rotating apparatuses is also desired.

PTL 2 describes that the concave portions are provided at the periphery of the cylinder block. However, these concave portions just serve as the detected concave portions detected by the rotation sensor and do not cool the cylinder block.

An object of the present invention is to provide a cylinder block capable of improving a cooling effect of a sliding surface in accordance with the number of cylinder bores, a rotational frequency, and the like, and a swash plate type liquid-pressure rotating apparatus including the cylinder block.

Solution to Problem

To achieve the above object, a cylinder block according to the present invention includes: a plurality of cylinder bores including respective openings formed on a piston insertion end surface of the cylinder block, pistons being inserted in the respective cylinder bores and being configured to reciprocate and slide in the respective cylinder bores when the cylinder block rotates; and a cooling portion, wherein the cooling portion includes a plurality of cooling holes each formed between the adjacent cylinder bores and extending from the piston insertion end surface in an axial direction of the cylinder block.

According to this configuration, when the cylinder block rotates, an ambient cooling liquid (operating oil) that is relatively low in temperature is introduced to the cooling holes of the cooling portion, the cooling holes each being located between the cylinder bores each including a sliding surface on which the piston slides and which becomes high in temperature. The cooling liquid introduced to the cooling holes removes heat from the cylinder block and flows out from the cooling holes. Thus, the cylinder block can be appropriately cooled by the cooling liquid. With this, the cooling performance of the cylinder block can be improved, and the temperature increase of the sliding surface can be suppressed. In addition, since the cooling holes extend from the piston insertion end surface on which the openings of the cylinder bores are located, the temperature increase can be especially suppressed at portions of the sliding surfaces which portions are located close to the piston insertion end surface and most significantly increase in temperature.

Each of the cooling holes may be inclined so as to penetrate the cylinder block from the piston insertion end surface toward an outer peripheral surface of the cylinder block.

According to this configuration, the cooling liquid flowing into the cooling holes through the piston insertion end surface is discharged to the outer peripheral surface of the cylinder block by centrifugal force generated by the rotation of the cylinder block. Therefore, forced flow of the cooling liquid is generated, and this can improve the cooling effect of the cylinder block.

Each of the cooling holes may include: a linear portion extending in parallel with the cylinder bore; and a drain hole portion extending from a position of the linear portion toward an outer peripheral surface of the cylinder block and being open on the outer peripheral surface, the position being located away from the piston insertion end surface.

According to this configuration, the cooling liquid flowing into the linear portions of the cooling holes through the piston insertion end surface is discharged through the drain hole portions to the outer peripheral surface of the cylinder block by the centrifugal force generated by the rotation of the cylinder block. Therefore, forced flow of the cooling liquid is generated, and this can improve the cooling effect of the cylinder block.

A cylinder block according to the present invention may include: a plurality of cylinder bores including respective openings formed on a piston insertion end surface of the cylinder block, pistons being inserted in the respective cylinder bores and being configured to reciprocate and slide in the respective cylinder bores when the cylinder block rotates; and a cooling portion, wherein the cooling portion may include a plurality of cooling holes each extending in a radial direction from an outer peripheral surface of the cylinder block through a portion between the adjacent cylinder bores.

According to this configuration, when the cylinder block rotates, the ambient cooling liquid (operating oil) that is relatively low in temperature is introduced to the cooling holes each extending from the outer peripheral surface of the cylinder block through a portion between the adjacent cylinder bores. The cooling liquid introduced to the cooling holes removes heat from the cylinder block and then flows out from the cooling holes. Thus, the cylinder block can be appropriately cooled by the cooling liquid.

A cylinder block according to the present invention may include: a plurality of cylinder bores including respective openings formed on a piston insertion end surface of the cylinder block, pistons being inserted in the respective cylinder bores and being configured to reciprocate and slide in the respective cylinder bores when the cylinder block rotates; and a cooling portion, wherein the cooling portion may include a plurality of cooling holes each extending in a radial direction from an outer peripheral surface of the cylinder block.

According to this configuration, when the cylinder block rotates, the ambient cooling liquid (operating oil) that is relatively low in temperature is introduced to the cooling holes each extending from the outer peripheral surface of the cylinder block in the radial direction. The cooling liquid introduced to the cooling holes removes heat from the cylinder block and then flows out from the cooling holes. Thus, the cylinder block can be appropriately cooled by the cooling liquid.

The cylinder block may be configured such that: the cylinder bores include respective insert bushings; and each of the cooling holes extends from the outer peripheral surface of the cylinder block to a position of an outer surface of the insert bushing.

According to this configuration, the cylinder bores include the insert bushings, and the cooling liquid is introduced to the positions of the insert bushings of the cylinder bores. Thus, the positions close to the cylinder bores which become high in temperature can be appropriately cooled.

A cylinder block according to the present invention may include: a plurality of cylinder bores including respective openings formed on a piston insertion end surface of the cylinder block, pistons being inserted in the respective cylinder bores and being configured to reciprocate and slide in the respective cylinder bores when the cylinder block rotates; and a cooling portion, wherein the cooling portion may include: an annular cutout portion formed at an edge portion of the piston insertion end surface of the cylinder block; and a plurality of cooling grooves formed on an outer peripheral surface of the cylinder block so as to extend from the annular cutout portion in an axial direction of the cylinder block.

According to this configuration, when the cylinder block rotates, the ambient cooling liquid (operating oil) that is low in temperature is introduced to an outer peripheral portion of the piston insertion end surface of the cylinder block by the annular cutout portion formed at the edge portion of the piston insertion end surface. The cooling liquid is then introduced through the cutout portion to the cooling grooves formed on the outer peripheral surface of the cylinder block and removes heat from the cylinder block. Thus, the cylinder block can be appropriately cooled.

A cylinder block according to the present invention may include: a plurality of cylinder bores including respective openings formed on a piston insertion end surface of the cylinder block, pistons being inserted in the respective cylinder bores and being configured to reciprocate and slide in the respective cylinder bores when the cylinder block rotates; and a cooling portion, wherein the cooling portion includes a plurality of cooling grooves each located between the adjacent cylinder bores and formed on an outer peripheral surface of the cylinder block so as to extend from the piston insertion end surface in an axial direction of the cylinder block.

According to this configuration, when the cylinder block rotates, the ambient cooling liquid (operating oil) that is relatively low in temperature is introduced to the cooling grooves each extending from the piston insertion end surface of the cylinder block in the axial direction of the cylinder block. The cooling liquid introduced to the cooling grooves removes heat from the cylinder block and flows out from the cooling grooves. Thus, the cylinder block can be appropriately cooled by the cooling liquid.

A swash plate type liquid-pressure rotating apparatus according to the present invention is connected to a low-pressure passage through which a low-pressure operating liquid flows and a high-pressure passage through which high-pressure operating oil flows, the swash plate type liquid-pressure rotating apparatus being configured to rotate a cylinder block by supplying the operating liquid through the high-pressure passage to cylinder bores of the cylinder block and discharging the operating liquid from the cylinder bores to the low-pressure passage or the swash plate type liquid-pressure rotating apparatus being configured to suck the operating liquid through the low-pressure passage to the cylinder bores by rotating the cylinder block, compress the operating liquid, and eject the operating liquid to the high-pressure passage, the swash plate type liquid-pressure rotating apparatus including any of the above cylinder blocks.

According to this configuration, in the swash plate type liquid-pressure rotating apparatus in which: a clearance is provided between the sliding surface of the cylinder bore and the outer peripheral surface of the piston; and the operating oil leaking through the clearance is utilized as lubricating oil, the temperature increase of the piston sliding surface of the cylinder block can be suppressed. Therefore, the temperature increase of the lubricating oil leaking through the clearance can be suppressed, and this can prevent the transition of the lubricating oil. Thus, the lubrication performance of the lubricating oil can be prevented from deteriorating, and the smooth movement of the piston can be kept.

Advantageous Effects of Invention

According to the present invention, in the cylinder block configured such that the pistons reciprocate and slide in the cylinder bores, the cooling effect of the cylinder block can be appropriately improved in accordance with conditions, such as the number of cylinder bores, the rotational frequency, and usages.

The above object, other objects, features, and advantages of the present invention will be made clear by the following detailed explanation of preferred embodiments with reference to the attached drawings.

BRIEF DESCRIPTION OF DRAWINGS

FIG. 2A is a perspective view, and FIG. 2B is a sectional view. FIG. 2C is a schematic diagram showing the flow of operating oil.

FIG. 3A is a perspective view, and FIG. 3B is a sectional view.

FIG. 4A is a perspective view, and FIG. 4B is a sectional view.

FIG. 5A is a perspective view, and FIG. 5B is a sectional view.

FIG. 6A is a perspective view, and FIG. 6B is a sectional view.

FIG. 7A is a perspective view, and FIG. 7B is a sectional view.

FIG. 8A is a perspective view, and FIG. 8B is a sectional view.

FIG. 9A is a perspective view, and FIG. 9B is a sectional view.

FIG. 10A is a perspective view, and FIG. 10B is a sectional view.

DESCRIPTION OF EMBODIMENTS

Hereinafter, embodiments of the present invention will be explained with reference to the drawings. The following embodiments will explain cylinder blocks 12A to 12I in a swash plate type liquid-pressure rotating apparatus 1. In the embodiments below, a left direction in FIG. 1 is referred to as a "front direction," and a right direction in FIG. 1 is referred to as a "rear direction."

Swash Plate Type Liquid-Pressure Rotating Apparatus

Figure 1:
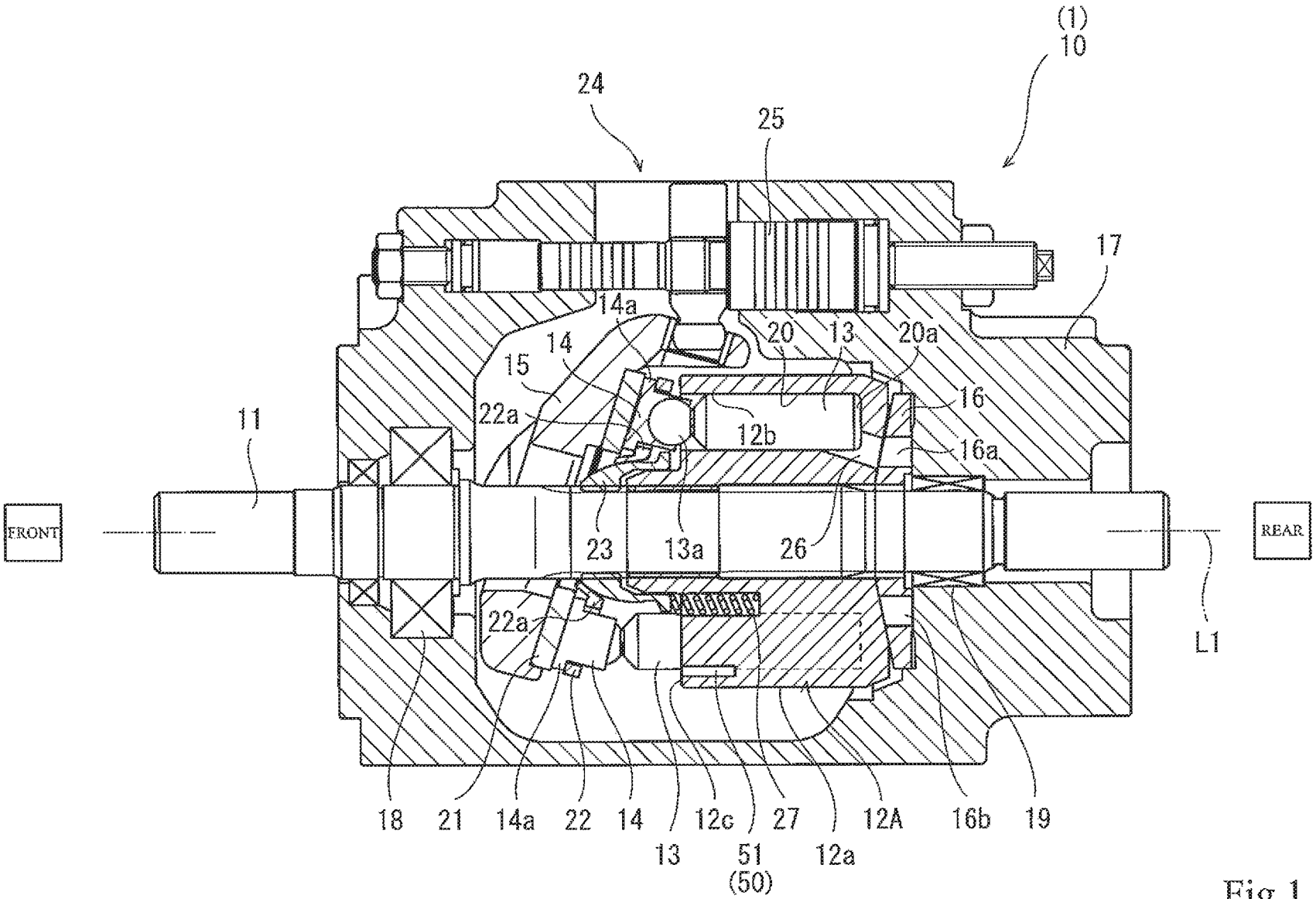
FIG. 1 is a sectional view showing a swash plate type liquid-pressure rotating apparatus including a cylinder block according to Embodiment 1 of the present invention.

FIG. 1 is a sectional view showing the swash plate type liquid-pressure rotating apparatus 1 including the cylinder block 12A according to Embodiment 1. In industrial machines and ships, the swash plate type liquid-pressure rotating apparatus 1 is provided so as to drive devices and actuators included in the industrial machines and ships. Examples of the industrial machines include: construction machines, such as hydraulic excavators, cranes, and bulldozers; and land apparatuses, such as hydraulic units, pressing machines, ironmaking machines, and injection molding machines. The swash plate type liquid-pressure rotating apparatus 1 is a so-called swash plate type motor/pump. The swash plate type liquid-pressure rotating apparatus 1 serves as a liquid-pressure motor configured to rotate a rotated object included in industrial machines and ships or a liquid-pressure pump configured to supply a pressure liquid to an actuator included in industrial machines and ships to operate the actuator. In the following, for convenience of explanation, an operating liquid used is operating oil, and the swash plate type liquid-pressure rotating apparatus 1 is explained as a hydraulic motor 10.

The hydraulic motor 10 (swash plate type liquid-pressure rotating apparatus 1) is a high-speed rotation type hydraulic motor including a rotating shaft 11 and configured to be able to rotate the rotating shaft 11 at a high-speed rotational frequency. In addition to the rotating shaft 11, the hydraulic motor 10 includes the cylinder block 12A, a plurality of pistons 13, a plurality of shoes 14, a swash plate 15, and a valve plate 16, and these components are accommodated in a casing 17. The rotating shaft 11 extends in a front-rear direction so as to penetrate the casing 17. The rotating shaft 1 is supported by bearings 18 and 19 at front and rear end portions of the casing 17 so as to be rotatable. An intermediate portion of the rotating shaft 11 is fittingly inserted into the cylinder block 12A.

The cylinder block 12A is formed in a substantially cylindrical shape. An axis of the cylinder block 12A coincides with an axis L1 of the rotating shaft 11. The cylinder block 12A is integrally splined to the rotating shaft 11 and rotates integrally with the rotating shaft 11. A plurality of cylinder bores 20 are formed at the cylinder block 12A. The cylinder bores 20 are arranged around the axis L1 at regular intervals in a circumferential direction of the cylinder block 12A (see FIG. 2) and extend in parallel with the axis L1. The cylinder bores 20 are holes each defined by a bottom surface and a sliding surface having a circular section and include respective openings on a piston insertion end surface 12*c* (front end surface) of the cylinder block 12A. The pistons 13 are inserted and fitted into the cylinder bores 20 through the openings.

Each of the pistons 13 is formed in a substantially columnar shape and reciprocates and slides in the front-rear direction while sliding on a sliding surface 12*b* defining the cylinder bore 20. In some cases, cylindrical sleeves (not shown), such as copper bushings, are fitted to the cylinder bores 20. In this case, the piston 13 slides on an inner peripheral surface of the sleeve. Therefore, the sliding surface on which the piston 13 slides denotes the inner peripheral surface of the sleeve. The following will explain a case where the sleeves are not fitted. However, the following is applicable to a case where the sleeves are fitted.

An outer diameter of the piston 13 is slightly smaller than an inner diameter of the cylinder bore 20. A clearance is formed around the piston 13, i.e., between the piston 13 and the sliding surface 12*b*. The piston 13 includes a spherical support portion 13*a* at a front end portion thereof. The spherical support portion 13*a* projects from the cylinder bore 20 regardless of the position of the piston 13. An outer surface of the spherical support portion 13*a* is formed in a substantially spherical shape, and a shoe 14 is attached to the spherical support portion 13*a*.

The shoe 14 is formed in a substantially bottomed cylindrical shape, and an inner surface of the shoe 14 is formed in a partially spherical shape corresponding to the spherical support portion 13*a*. The spherical support portion 13*a* of the piston 13 is fitted in the shoe 14, and the piston 13 is turnable about a center point that is a center of the spherical support portion 13*a*. The shoe 14 includes a flange 14*a* at a bottom portion thereof, and the flange 14*a* projects outward in a radial direction. The shoe 14 is arranged on the swash plate 15 with the bottom portion contacting the swash plate 15.

The swash plate 15 is formed in a substantially circular plate shape. The swash plate 15 is provided in the casing 17 such that an upper portion of the swash plate 15 is inclined rearward. The rotating shaft 11 penetrates a substantially center of the swash plate 15. The swash plate 15 is arranged in front of the cylinder block 12A and includes a supporting plate 21 located close to the cylinder block 12A. The supporting plate 21 is formed in an annular shape, and the shoes 14 are arranged at the supporting plate 21 at regular intervals in the circumferential direction. A retainer plate 22 is provided at the shoes 14 so as to press the shoes 14 against the supporting plate 21.

The retainer plate 22 is formed in a substantially annular shape. The rotating shaft 11 is inserted through a center of the retainer plate 22 so as to be rotatable relative to the retainer plate 22. The retainer plate 22 includes attachment holes 22*a*, the number of which is equal to the number of shoes 14. The attachment holes 22*a* are arranged at regular intervals in the circumferential direction. Opening-side portions of the shoes 14 are inserted into the attachment holes 22*a* of the retainer plate 22, and the retainer plate 22 contacts the flanges 14*a*. Thus, the retainer plate 22 sandwiches the flanges 14*a* in cooperation with the supporting plate 21. A spherical bushing 23 is inserted into an inner hole of the retainer plate 22. The spherical bushing 23 is formed in a substantially cylindrical shape and is externally attached to the rotating shaft 11 and the cylinder block 12A. The spherical bushing 23 is biased toward the supporting plate 21 by a plurality of pressing springs 27 provided at the cylinder block 12A. The retainer plate 22 is pressed against the supporting plate 21 by the spherical bushing 23.

The upper portion of the swash plate 15 at which the shoes 14 are arranged is coupled to a regulator 24 provided at an upper portion of the casing 17. The regulator 24 includes a plunger 25 configured to be movable in the front-rear direction. The swash plate 15 is coupled to the plunger 25. Therefore, by moving the plunger 25 in the front-rear direction, an inclination angle of the swash plate changes, and this can adjust strokes of the pistons 13. Thus, capacities of oil chambers 20*a* of the cylinder bores 20 can be changed. The oil chamber 20*a* is a space behind a rear end surface of the piston 13 in the cylinder bore 20.

The cylinder block 12A includes cylinder ports 26 communicating with the oil chambers 20*a*. One cylinder port 26 is provided for one cylinder bore 20, i.e., the cylinder ports 26 correspond one-to-one to the cylinder bores 20. The cylinder ports 26 are open on a rear end surface of the cylinder block 12A, and the valve plate 16 is provided on the rear end surface of the cylinder block 12A.

The valve plate 16 is a plate-shaped member formed in an annular shape and is located between the cylinder block 12A and a rear end portion of the casing 17. The valve plate 16 is fixed to the casing 17 by a pin member (not shown) so as not to be rotatable relative to the casing 17. The rotating shaft 11 is inserted through an inner hole of the valve plate 16. The rotating shaft 11 and the valve plate 16 are rotatable relative to each other. The valve plate 16 located as above includes an inlet port 16*a* and an outlet port 16*b*.

Each of the inlet port 16*a* and the outlet port 16*b* is formed in a substantially circular-arc shape. The inlet port 16*a* and the outlet port 16*b* are located so as to be spaced apart from each other in the circumferential direction. The inlet port 16*a* and the outlet port 16*b* penetrate the valve plate 16 in a thickness direction of the valve plate 16. Each of an opening of the inlet port 16*a* and an opening of the outlet port 16*b* is connected to some cylinder ports 26, the openings being located close to the cylinder block 12A. When the cylinder block 12A rotates, a port to which the cylinder port 26 is connected is alternately switched between the inlet port 16*a* and the outlet port 16*b*. A high-pressure passage (not shown) is connected to the opening of the inlet port 16*a*, and a low-pressure passage (not shown) is connected to the opening of the outlet port 16*b*. With this, when the cylinder block 12A rotates, the cylinder bore 20 is alternately connected to the high-pressure passage and the low-pressure passage. In FIG. 1, for convenience of explanation, the positions of the inlet port 16*a* and the outlet port 16*b* are shifted in the circumferential direction from the actual positions of the inlet port 16*a* and the outlet port 16*b*.

According to the hydraulic motor 10 configured as above, the operating oil flowing through the high-pressure passage is sucked through the inlet port 16*a* into the oil chamber 20*a* while the piston 13 is moving from a top dead center to a bottom dead center. At the top dead center, the piston 13 retracts most in the cylinder bore 20 and is located at a deepest portion of the cylinder bore 20. At the bottom dead center, the piston 13 projects most from the cylinder bore 20. With this, the piston 13 is pushed forward by the operating oil, and as a result, the shoe 14 is pressed against the swash plate 15. Since the swash plate 15 is in an inclined state, the shoe 14 pressed against the swash plate 15 slides on the swash plate 15 downward and rotates around the axis L1 toward one side in the circumferential direction. With this, rotational force around the axis L1 is applied to the cylinder block 12A, and thus, the cylinder block 12A and the rotating shaft 11 rotate about the axis L1.

In contrast, while the piston 13 is moving from the bottom dead center to the top dead center, the oil chamber 20*a* is connected to the low-pressure passage through the outlet port 16*b*. When the cylinder block 12A rotates, the shoe 14 slides on the swash plate 15 upward and rotates around the axis L1 toward one side in the circumferential direction. When the shoe 14 slides on the swash plate 15 upward, the piston 13 is pushed backward, and with this, the operating oil in the oil chamber 20*a* is discharged to the low-pressure passage through the outlet port 16*b*. As above, in the hydraulic motor 10, by sucking and ejecting the operating oil, the piston 13 reciprocates and slides in the front-rear direction, and with this, the cylinder block 12A and the rotating shaft 11 rotate about the axis L1.

When the swash plate type liquid-pressure rotating apparatus 1 serves as a hydraulic pump, the operating oil is sucked from the low-pressure passage into the cylinder bore 20 by the rotation of the cylinder block 12A, and the operating oil compressed in the cylinder bore 20 is ejected to the high-pressure passage.

The cylinder block 12A includes a structure configured to cool the cylinder block 12A. The cylinder block 12A of Embodiment 1 shown in the drawings includes a plurality of cooling holes 51 as a cooling portion 50. In addition to the cooling holes 51, examples of the cooling portion 50 include cooling grooves 55 shown in FIGS. 8A to 10B described later. Hereinafter, embodiments of the cylinder block including the cooling portion 50 will be explained. In the following embodiments, an axis of the cylinder block 12A is explained as the axis L1, and the same reference signs are used for the same components.

Cylinder Block of Embodiment 1

Figure 2A:
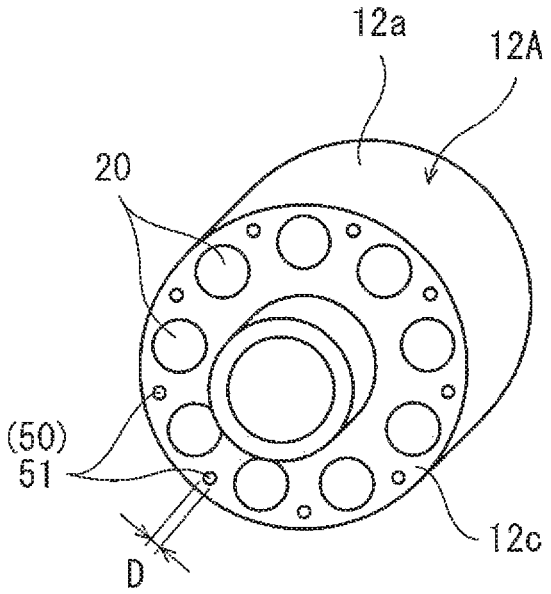
FIGS. 2A, 2B, and 2C are diagrams each showing only the cylinder block according to Embodiment 1 shown in FIG. 1.
Figure 2B:
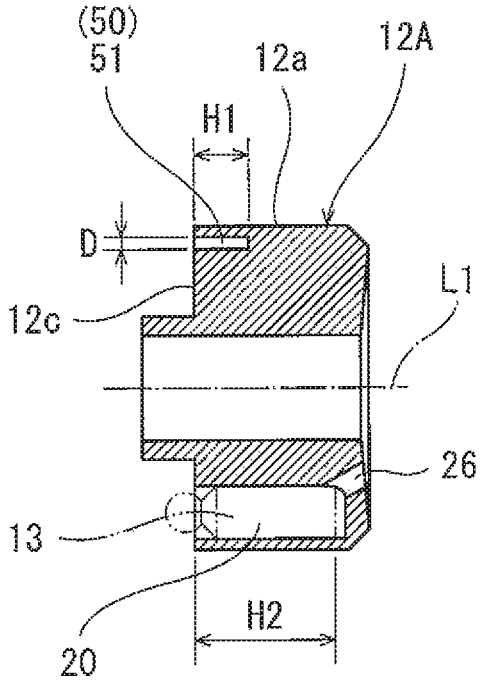
Figure 2C:
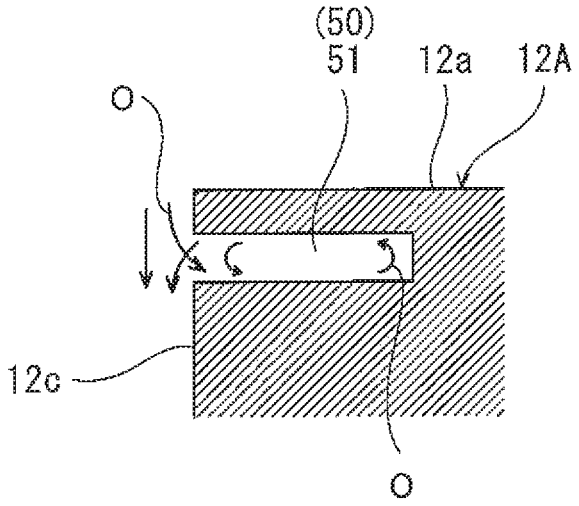

FIGS. 2A, 2B, and 2C are diagrams each showing only the cylinder block 12A according to Embodiment 1 shown in FIG. 1. FIG. 2A is a perspective view, and FIG. 2B is a sectional view. FIG. 2C is a schematic diagram showing the flow of the operating oil. The cylinder block 12A includes the cooling holes 51 as the cooling portion 50. A section of the cooling hole 51 is shown at an upper portion of the sectional view of FIG. 2B, and a section of the cylinder bore 20 is shown at a lower portion of the sectional view of FIG. 2B.

In the cylinder block 12A of the present embodiment, each of the cooling holes 51 extending from the piston insertion end surface 12*c* in a direction along the axis L1 is provided at a position between the adjacent cylinder bores 20 and close to an outer peripheral surface 12*a* of the cylinder block 12A. The cooling hole 51 of the present embodiment is provided between the adjacent cylinder bores 20 so as to be located at a position closer to the outer peripheral surface 12*a* of the cylinder block 12A than the center of the cylinder bore 20.

An axial depth H1 of the cooling hole 51 falls within a range of a depth H2 from the piston insertion end surface 12*c* to the position of the deepest portion of the cylinder bore 20 into which the piston 13 is inserted. To be specific, the cooling hole 51 is formed within a range from the piston insertion end surface 12*c* to the position of the deepest portion of the cylinder bore 20 into which the piston 13 is inserted (in other words, a deepest portion of the piston 13 when the piston 13 is located at the top dead center). The axial depth H1 in the present embodiment extends from the piston insertion end surface 12*c* and falls within a range that is about half the depth H2 from the piston insertion end surface 12*c* to the position of the deepest portion of the cylinder bore 20 into which the piston 13 is inserted.

A diameter D of the cooling hole 51 falls within a range of 5% to 100% of the diameter of the piston 13. When the diameter D of the cooling hole 51 falls within a range of 5% to 100% of the diameter of the piston 13, the cooling holes 51 which can appropriately cool the cylinder block 12A under various conditions can be formed. The diameter D of the cooling hole 51 is set to such a size that the operating oil flowing into the cooling hole 51 from the piston insertion end surface 12*c* flows in the cooling hole 51 to cool the cylinder block 12A and is then discharged through the piston insertion end surface 12*c*. For example, the diameter D of the cooling hole 51 may be set to about 3 to 10 mm.

As shown in FIG. 2C, according to the cylinder block 12A of the present embodiment, when the cylinder block 12A rotates, ambient operating oil O that is relatively low in temperature is introduced to the cooling hole 51 located close to the sliding surface 12*b* on which the piston 13 slides and which becomes high in temperature. Then, the introduced operating oil O makes the operating oil O in the cooling hole 51 flow. After the operating oil O removes heat from the cylinder block 12A, the operating oil O flows out from the cooling hole 51. Thus, the cylinder block 12A can be appropriately cooled.

With this, the cooling performance of the cylinder block 12A can be improved, and the temperature increase of the sliding surface 12*b* can be suppressed. In addition, since the cooling holes 51 extend from the piston insertion end surface 12*c* on which the openings of the cylinder bores 20 are located, the temperature increase can be especially suppressed at portions of the sliding surfaces 12*b* which portions are located close to the piston insertion end surface 12*c* and most significantly increase in temperature.

Cylinder Block of Embodiment 2

Figure 3A:
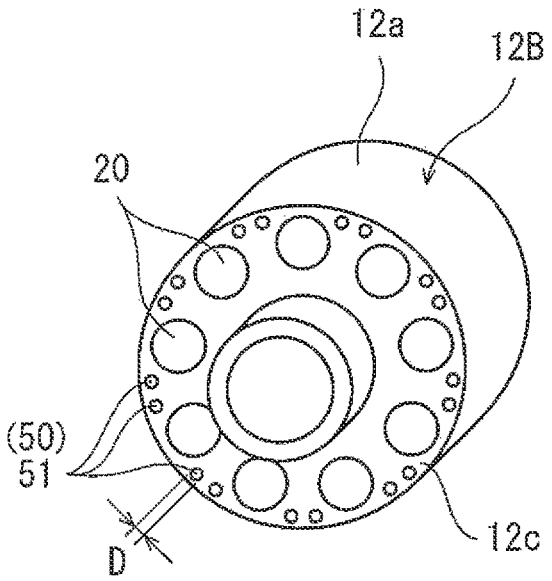
FIGS. 3A and 3B are diagrams each showing only the cylinder block according to Embodiment 2 in the swash plate type liquid-pressure rotating apparatus shown in FIG. 1.
Figure 3B:
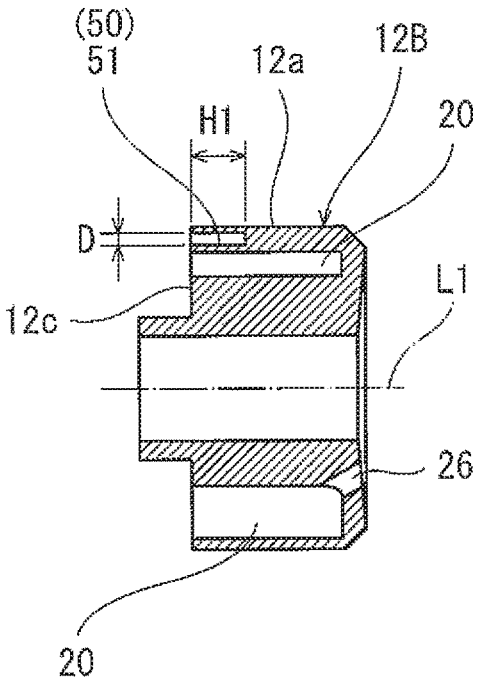

FIGS. 3A and 3B are diagrams each showing only the cylinder block 12B according to Embodiment 2 in the hydraulic motor 10 (swash plate type liquid-pressure rotating apparatus 1). FIG. 3A is a perspective view, and FIG. 3B is a sectional view. The cylinder block 12B includes the cooling holes 51 as the cooling portion 50. A section of the cooling hole 51 is shown at an upper portion of the sectional view of FIG. 3B, and a section of the cylinder bore 20 is shown at a lower portion of the sectional view of FIG. 3B.

In the cylinder block 12B of the present embodiment, each of the cooling holes 51 extending from the piston insertion end surface 12*c* in the direction along the axis L1 of the cylinder block 12B is provided between the adjacent cylinder bores 20 and at a radially outer side of the cylinder block 12B. In the present embodiment, two cooling holes 51 are provided between the adjacent cylinder bores 20 and at the outer side so as to be located at positions close to the outer peripheral surface 12*a* of the cylinder block 12B.

According to the cylinder block 12B of the present embodiment, as with the cylinder block 12A, the operating oil that is relatively low in temperature is introduced to the cooling hole 51 located close to the sliding surface 12*b* on which the piston 13 slides and which becomes high in temperature. Thus, the cylinder block 12B can be appropriately cooled. With this, the cooling performance of the cylinder block 12B can be improved, and the temperature increase of the sliding surface 12*b* can be suppressed. In addition, positions closer to the cylinder bores 20 than the cylinder block 12A of Embodiment 1 can be cooled.

Cylinder Block of Embodiment 3

Figure 4A:
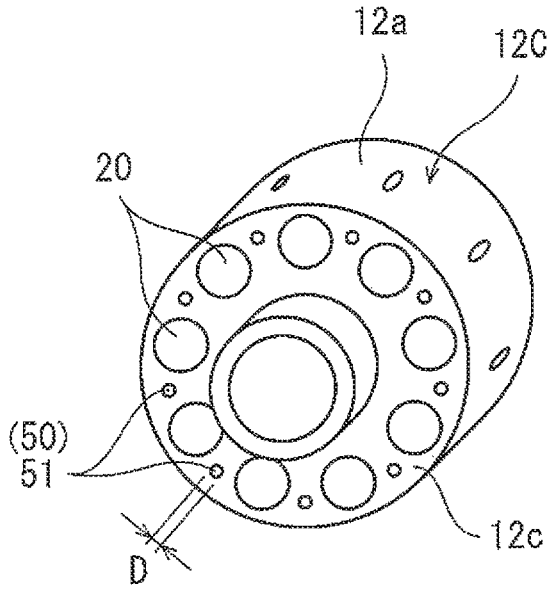
FIGS. 4A and 4B are diagrams each showing only the cylinder block according to Embodiment 3 in the swash plate type liquid-pressure rotating apparatus shown in FIG. 1.
Figure 4B:
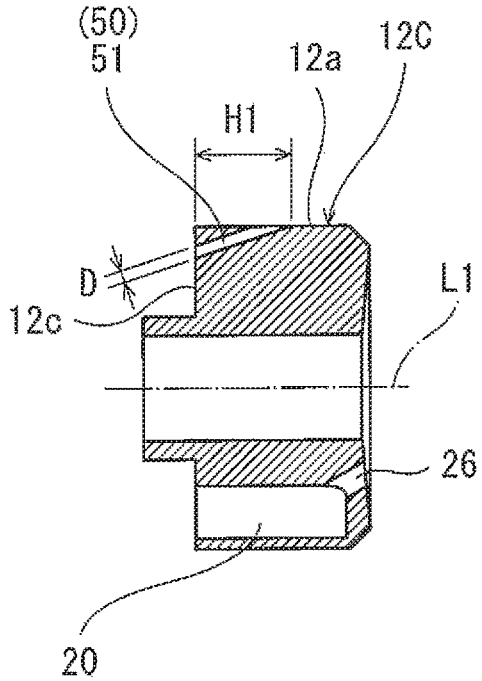

FIGS. 4A and 4B are diagrams each showing only the cylinder block 12C according to Embodiment 3 in the hydraulic motor 10 (swash plate type liquid-pressure rotating apparatus 1). FIG. 4A is a perspective view, and FIG. 4B is a sectional view. The cylinder block 12C includes the cooling holes 51 as the cooling portion 50. A section of the cooling hole 51 is shown at an upper portion of the sectional view of FIG. 4B, and a section of the cylinder bore 20 is shown at a lower portion of the sectional view of FIG. 4B.

In the cylinder block 12C of the present embodiment, each of the cooling holes 51 extending from the piston insertion end surface 12*c* in the direction along the axis L1 is provided at a position between the adjacent cylinder bores 20 and close to the outer peripheral surface 12*a*. The cooling holes 51 of the present embodiment are holes that are inclined so as to penetrate the cylinder block 12C from the piston insertion end surface 12*c* toward the outer peripheral surface 12*a* of the cylinder block 12C.

According to the cylinder block 12C of the present embodiment, as with the cylinder block 12A, the operating oil that is relatively low in temperature is introduced to the cooling hole 51 located close to the sliding surface 12*b* on which the piston 13 slides and which becomes high in temperature. Thus, the cylinder block 12C can be appropriately cooled. With this, the cooling performance of the cylinder block 12C can be improved, and the temperature increase of the sliding surface 12*b* can be suppressed. In addition, the operating oil flowing into the cooling hole 51 from the piston insertion end surface 12*c* can be discharged to the outer peripheral surface 12*a* of the cylinder block 12C by centrifugal force generated by the rotation of the cylinder block 12C. Therefore, forced flow of the operating oil is generated in the cooling hole 51, and this can improve the cooling effect.

Cylinder Block of Embodiment 4

Figure 5A:
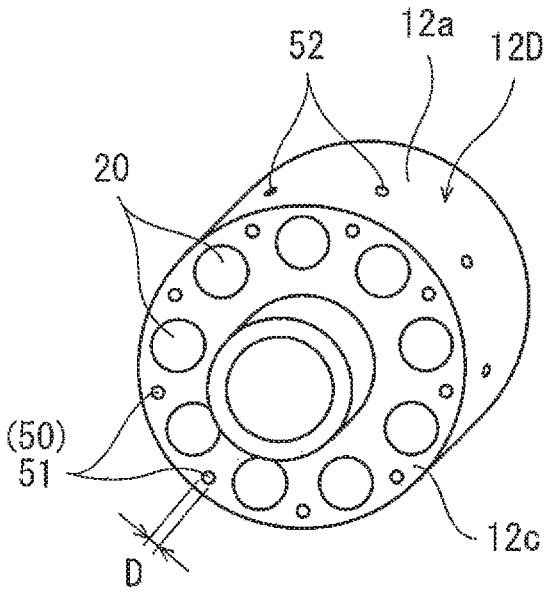
FIGS. 5A and 5B are diagrams each showing only the cylinder block according to Embodiment 4 in the swash plate type liquid-pressure rotating apparatus shown in FIG. 1.
Figure 5B:
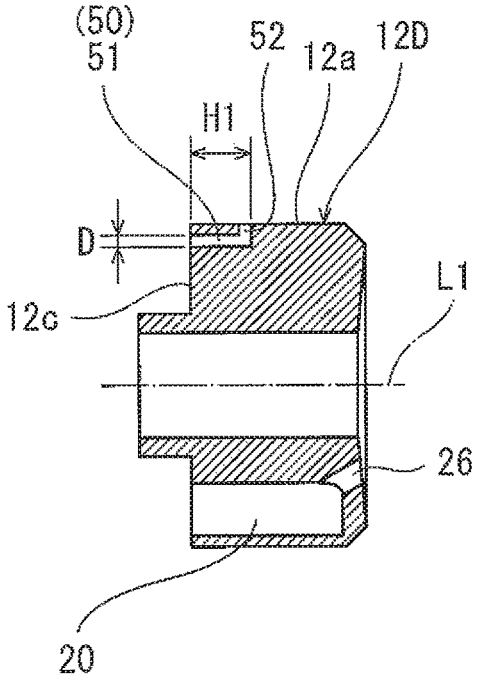

FIGS. 5A and 5B are diagrams each showing only the cylinder block 12D according to Embodiment 4 in the hydraulic motor 10 (swash plate type liquid-pressure rotating apparatus 1). FIG. 5A is a perspective view, and FIG. 5B is a sectional view. The cylinder block 12D includes the cooling holes 51 as the cooling portion 50. A section of the cooling hole 51 is shown at an upper portion of the sectional view of FIG. 5B, and a section of the cylinder bore 20 is shown at a lower portion of the sectional view of FIG. 5B.

In the cylinder block 12D of the present embodiment, each of the cooling holes 51 extending from the piston insertion end surface 12*c* in the direction along the axis L1 is provided at a position between the adjacent cylinder bores 20 and close to the outer peripheral surface 12*a*. The cooling hole 51 of the present embodiment includes a linear portion and a drain hole portion 52. The linear portion extends in parallel with the cylinder bore 20. The drain hole portion 52 extends from a deep position of the linear portion toward the outer peripheral surface 12*a* of the cylinder block 12D and is open on the outer peripheral surface 12*a*, the deep position being located away from the piston insertion end surface 12*c*.

According to the cylinder block 12D of the present embodiment, as with the cylinder block 12A, the operating oil that is relatively low in temperature is introduced to the cooling hole 51 located close to the sliding surface 12*b* on which the piston 13 slides and which becomes high in temperature. Thus, the cylinder block 12D can be appropriately cooled. With this, the cooling performance of the cylinder block 12D can be improved, and the temperature increase of the sliding surface 12*b* can be suppressed. In addition, the operating oil flowing into the cooling hole 51 from the piston insertion end surface 12*c* can be discharged through the drain hole portion 52 to the outer peripheral surface 12*a* of the cylinder block 12D by the centrifugal force generated by the rotation of the cylinder block 12D. Therefore, forced flow of the operating oil is generated in the cooling hole 51, and this can improve the cooling effect.

Cylinder Block of Embodiment 5

Figure 6A:
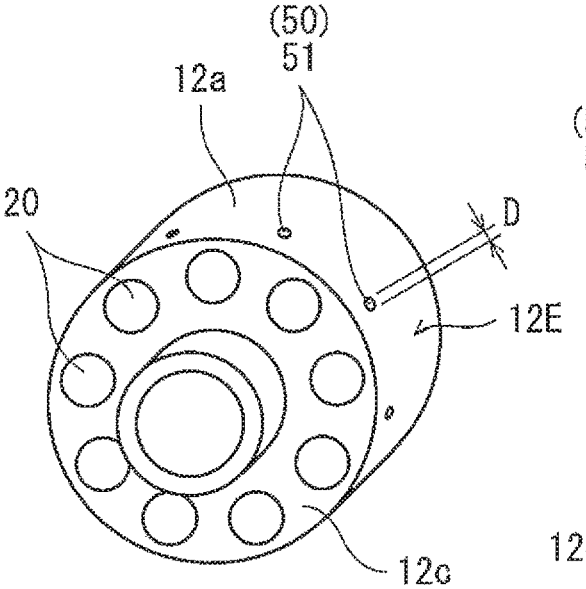
FIGS. 6A and 6B are diagrams each showing only the cylinder block according to Embodiment 5 in the swash plate type liquid-pressure rotating apparatus shown in FIG. 1.
Figure 6B:
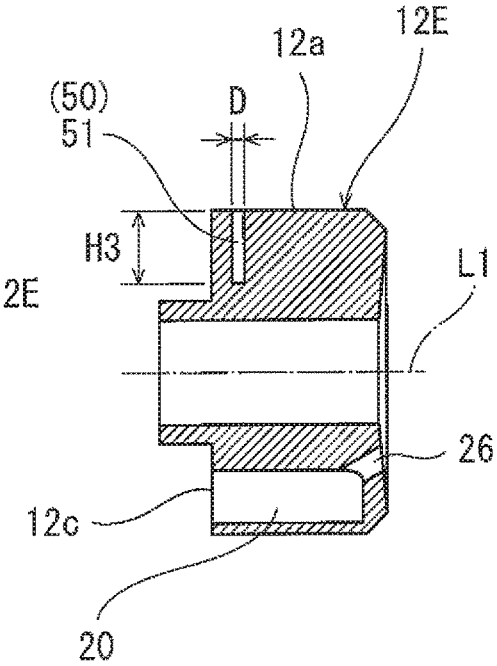

FIGS. 6A and 6B are diagrams each showing only the cylinder block 12E according to Embodiment 5 in the hydraulic motor 10 (swash plate type liquid-pressure rotating apparatus 1). FIG. 6A is a perspective view, and FIG. 6B is a sectional view. The cylinder block 12E includes the cooling holes 51 as the cooling portion 50. A section of the cooling hole 51 is shown at an upper portion of the sectional view of FIG. 6B, and a section of the cylinder bore 20 is shown at a lower portion of the sectional view of FIG. 6B.

The cylinder block 12E of the present embodiment includes the cooling holes 51 each extending from the outer peripheral surface 12*a* of the cylinder block 12E in a radial direction perpendicular to the axis L1 of the cylinder block 12E. Each of the cooling holes 51 is located between the adjacent cylinder bores 20 and has a radial depth H3, i.e., extends from the outer peripheral surface 12*a* through a portion between the adjacent cylinder bores 20 to a position away from the axis L1 of the cylinder block 12E by a predetermined distance. The radial depth H3 of the cooling hole 51 is set such that the predetermined distance is a distance from the axis L1 to a portion of the cylinder bore 20 which portion is the closest to the axis L1.

The present embodiment explains a case where the number of cooling holes 51 is one in the direction along the axis L1 of the cylinder block 12E. However, the cooling holes 51 may be additionally provided at positions required to be cooled in the direction along the axis L1, and the number of cooling holes 51 is not limited to the example shown in the drawings.

According to the cylinder block 12E of the present embodiment, by the cooling hole 51 extending between the adjacent cylinder bores 20, the operating oil that is relatively low in temperature and introduced to the cooling hole 51 can appropriately cool a position close to the sliding surface 12*b* on which the piston 13 slides and which becomes high in temperature. With this, the cooling performance of the cylinder block 12E can be improved, and the temperature increase of the sliding surface 12*b* can be suppressed.

Cylinder Block of Embodiment 6

Figure 7A:
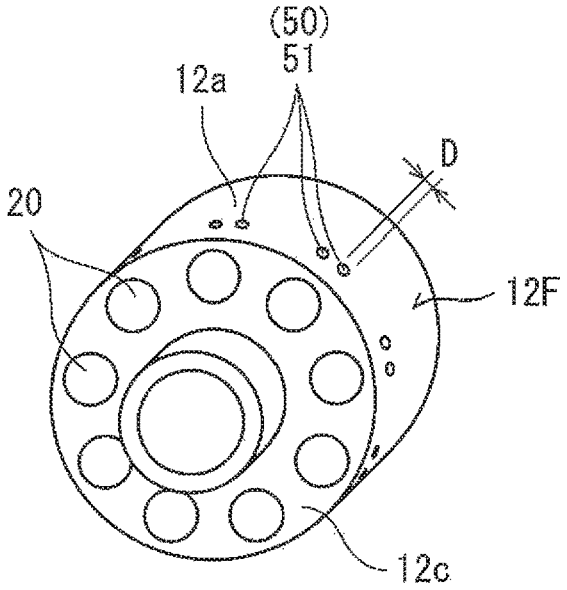
FIGS. 7A and 7B are diagrams each showing only the cylinder block according to Embodiment 6 in the swash plate type liquid-pressure rotating apparatus shown in FIG. 1.
Figure 7B:
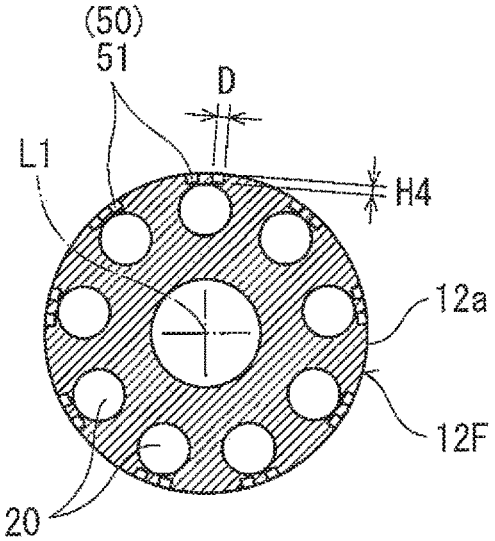

FIGS. 7A and 7B are diagrams each showing only the cylinder block 12F according to Embodiment 6 in the hydraulic motor 10 (swash plate type liquid-pressure rotating apparatus 1). FIG. 7A is a perspective view, and FIG. 7B is a sectional view. The cylinder block 12F includes the cooling holes 51 as the cooling portion 50. A section of the cooling hole 51 is shown at an upper portion of the sectional view of FIG. 7B, and a section of the cylinder bore 20 is shown at a lower portion of the sectional view of FIG. 7B.

The cylinder block 12F of the present embodiment includes the cooling holes 51 each extending from the outer peripheral surface 12*a* in the radial direction toward an outer periphery of the cylinder bore 20. Each of the cooling holes 51 has a radial depth H4, i.e., extends in the radial direction from the outer peripheral surface 12*a* of the cylinder block 12F to a position away from the outer periphery of the cylinder bore 20 by a predetermined distance. For example, when an insert bushing (not shown) is provided, the radial depth H4 of the cooling hole 51 can be set to a depth to a position of an outer surface of the insert bushing. When the cylinder bore 20 does not include the insert bushing, the cooling hole 51 may be provided so as to extend to a position close to the cylinder bore 20.

According to the cylinder block 12F of the present embodiment, the operating oil that is relatively low in temperature and introduced to the cooling hole 51 can appropriately cool a position close to the sliding surface 12*b* on which the piston 13 slides and which becomes high in temperature. With this, the cooling performance of the cylinder block 12F can be improved, and the temperature increase of the sliding surface 12*b* can be suppressed. In the present embodiment, according to need, the cooling holes 51 may be additionally provided in the direction along the axis L1 of the cylinder block 12F, and this can improve the cooling effect. The number of cooling holes 51 is not limited to the example shown in the drawings. The cooling holes 51 may be additionally provided at positions required to be cooled in the direction along the axis L1.

Cylinder Block of Embodiment 7

Figure 8A:
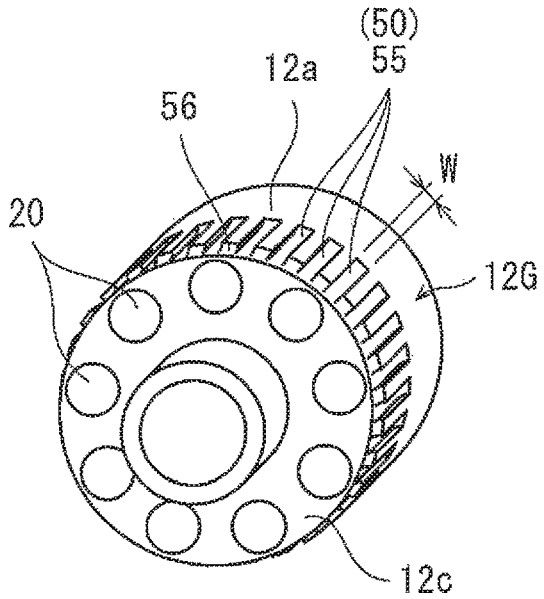
FIGS. 8A and 8B are diagrams each showing only the cylinder block according to Embodiment 7 in the swash plate type liquid-pressure rotating apparatus shown in FIG. 1.
Figure 8B:
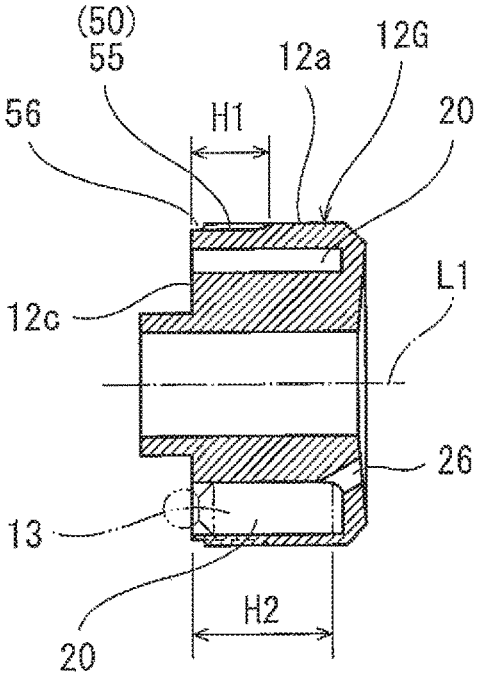

FIGS. 8A and 8B are diagrams each showing only the cylinder block 12G according to Embodiment 7 in the hydraulic motor 10 (swash plate type liquid-pressure rotating apparatus 1). FIG. 8A is a perspective view, and FIG. 8B is a sectional view. The cylinder block 12G includes the cooling grooves 55 as the cooling portion 50. A section of the cooling groove 55 is shown at an upper portion of the sectional view of FIG. 8B, and a section of the cylinder bore 20 is shown at a lower portion of the sectional view of FIG. 8B.

In the cylinder block 12G of the present embodiment, an annular cutout portion 56 is provided at an edge portion of the piston insertion end surface 12*c* of the cylinder block 12G so as to extend in the circumferential direction. The cutout portion 56 is formed by annularly cutting a corner portion of the outer peripheral surface 12*a* located close to the piston insertion end surface 12*c* of the cylinder block 12G.

The cooling grooves 55 are provided on the outer peripheral surface 12*a* of the cylinder block 12G so as to extend from the cutout portion 56 in the direction along the axis L1 of the cylinder block 12G Since the annular cutout portion 56 is provided at the corner portion of the outer peripheral surface 12*a* of the cylinder block 12Q and the cooling grooves 55 extend from the cutout portion 56, the operating oil smoothly flows from the cutout portion 56 to the cooling grooves 55.

The axial depth H1 of the cooling groove 55 falls within a range of the depth H2 from the piston insertion end surface 12*c* to the position of the deepest portion of the cylinder bore 20 into which the piston 13 is inserted (in other words, the deepest portion of the piston 13 when the piston 13 is located at the top dead center). The axial depth H1 in the present embodiment starts from the piston insertion end surface 12*c* and falls within a range that is about half the depth H2 from the piston insertion end surface 12*c* to the position of the deepest portion of the cylinder bore 20 into which the piston 13 is inserted. A width W of the cooling groove 55 falls within a range of 2% to 100% of the diameter of the piston 13.

The cooling grooves 55 of the present embodiment are provided on the outer peripheral surface 12*a* of the cylinder block 12G at regular intervals in the circumferential direction. With this, the outer peripheral surface 12*a* of the cylinder block 12G includes a concave-convex surface in which the concave cooling grooves 55 and the convex outer peripheral surfaces 12*a* each formed between the adjacent cooling grooves 55 are formed at regular intervals. Then, the operating oil that is relatively low in temperature and introduced to the cooling grooves 55 can appropriately cool the outer peripheral surface 12*a* of the cylinder block 12G With this, the cooling performance of the cylinder block 12G can be improved, and the temperature increase of the sliding surface 12*b* can be suppressed. In addition, according to the cylinder block 12G of the present embodiment, the concave-convex surface formed by the concave cooling grooves 55 and the convex outer peripheral surfaces 12*a* can also serve as a detected portion detected by a rotation sensor (not shown). When the concave-convex surface is used as the detected portion detected by the rotation sensor, the rotational frequency can be detected with a high degree of accuracy by increasing the number of cooling grooves 55.

Cylinder Block of Embodiment 8

Figure 9A:
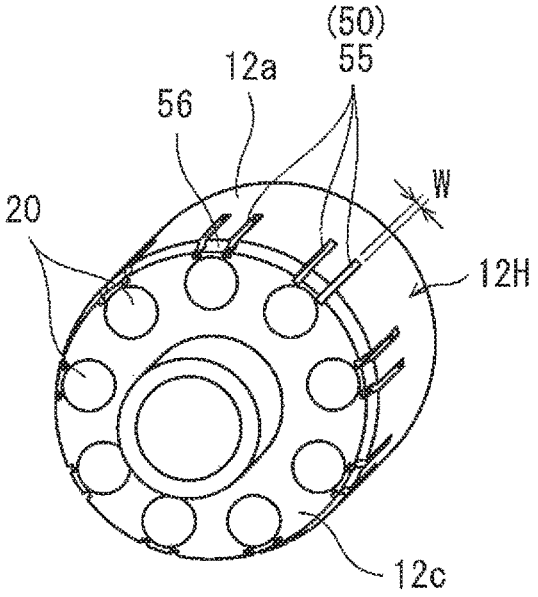
FIGS. 9A and 9B are diagrams each showing only the cylinder block according to Embodiment 8 in the swash plate type liquid-pressure rotating apparatus shown in FIG. 1.
Figure 9B:
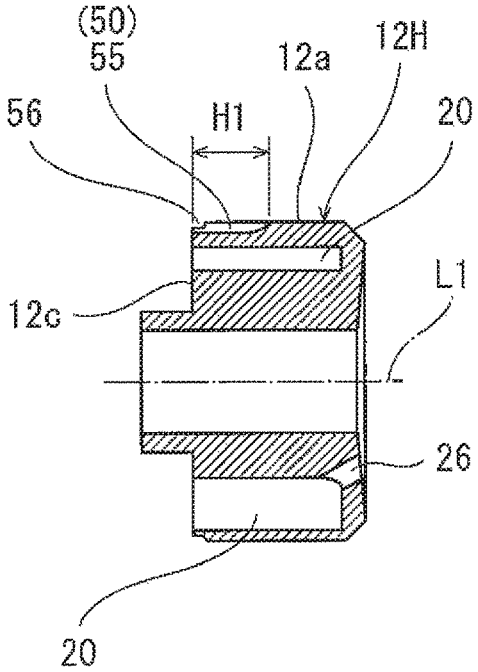

FIGS. 9A and 9B are diagrams each showing only the cylinder block 12H according to Embodiment 8 in the hydraulic motor 10 (swash plate type liquid-pressure rotating apparatus 1). FIG. 9A is a perspective view, and FIG. 9B is a sectional view. The cylinder block 12H includes the cooling grooves 55 as the cooling portion 50. A section of the cooling groove 55 is shown at an upper portion of the sectional view of FIG. 9B, and a section of the cylinder bore 20 is shown at a lower portion of the sectional view of FIG. 9B.

As with FIGS. 8A and 8B, in the cylinder block 12H of the present embodiment, the cutout portion 56 that is concave from the outer peripheral surface 12*a* is provided at the edge portion of the piston insertion end surface 12*c* of the cylinder block 12H so as to extend in the circumferential direction.

The cooling grooves 55 are provided so as to extend from the cutout portion 56 in an axial direction of the cylinder block 12H. Each of the cooling grooves 55 of the present embodiment is provided at a radially outer side of the cylinder bore 20 so as to extend from the cutout portion 56 in the direction along the axis L1 of the cylinder block 12H. The cooling groove 55 can also be provided in a range from the piston insertion end surface 12*c* to the position of the deepest portion of the cylinder bore 20 into which the piston 13 is inserted. It should be noted that the cutout portion 56 does not necessarily have to be provided.

According to the cylinder block 12H of the present embodiment, as with the cylinder block 12G the operating oil that is relatively low in temperature is introduced to the cooling grooves 55 of the outer peripheral surface 12*a* of the cylinder block 12H. Thus, the cylinder block 12H can be appropriately cooled. With this, the cooling performance of the cylinder block 12H can be improved, and the temperature increase of the sliding surface 12*b* can be suppressed.

Cylinder Block of Embodiment 9

Figure 10A:
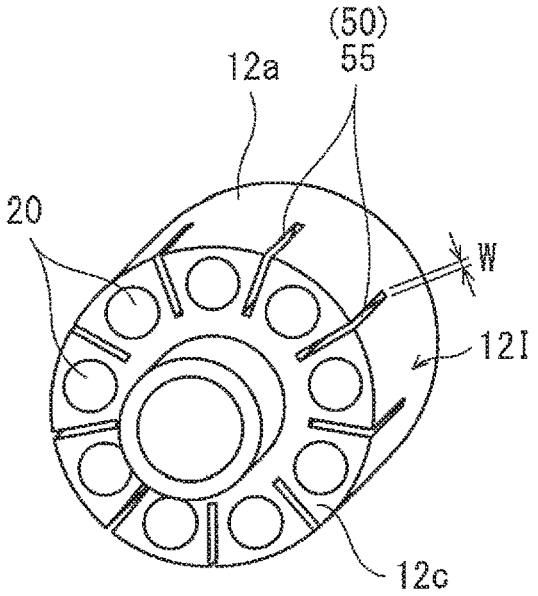
FIGS. 10A and 10B are diagrams each showing only the cylinder block according to Embodiment 9 in the swash plate type liquid-pressure rotating apparatus shown in FIG. 1.
Figure 10B:
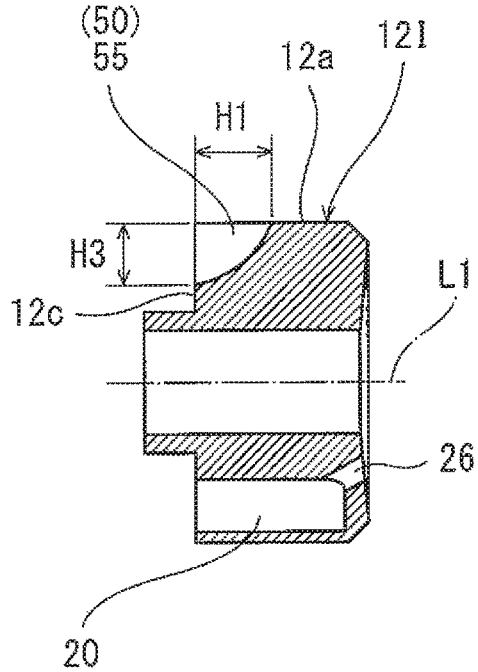

FIGS. 10A and 10B are diagrams each showing the cylinder block 12I according to Embodiment 9 in the hydraulic motor 10 (swash plate type liquid-pressure rotating apparatus 1). FIG. 10A is a perspective view, and FIG. 10B is a sectional view. The cylinder block 12I includes the cooling grooves 55 as the cooling portion 50. A section of the cooling groove 55 is shown at an upper portion of the sectional view of FIG. 10B, and a section of the cylinder bore 20 is shown at a lower portion of the sectional view of FIG. 10B.

The cylinder block 12I of the present embodiment includes the cooling grooves 55 extending from the piston insertion end surface 12*c* in the direction along the axis L1 of the cylinder block 12I. Each of the cooling grooves 55 of the present embodiment is located between the adjacent cylinder bores 20 on the piston insertion end surface 12*c* and has the radial depth H3, i.e., extends from the outer peripheral surface 12*a* through a portion between the adjacent cylinder bores 20 to a position away from the axis L1 of the cylinder block 12I by a predetermined distance. The radial depth H3 of the cooling groove 55 is set such that the predetermined distance is a distance from the axis L1 to a portion of the cylinder bore 20 which portion is the closest to the axis L1. Then, the cooling grooves 55 are formed on the outer peripheral surface 12*a* of the cylinder block 12I so as to extend from the piston insertion end surface 12*c* in the direction along the axis L1. Further, each of the cooling grooves 55 of the present embodiment is formed in a circular-arc shape that curves from the piston insertion end surface 12*c* toward the outer peripheral surface 12*a* of the cylinder block 12I. The axial depth H1 of the cooling groove 55 falls within a range of the depth H2 from the piston insertion end surface 12*c* to the deepest portion of the cylinder bore 20 into which the piston 13 is inserted. It should be noted that the cutout portion 56 may be provided as with Embodiment 8.

According to the cylinder block 12I of the present embodiment, by the cooling groove 55 provided between the adjacent cylinder bores 20, the operating oil that is relatively low in temperature is introduced to a position close to the sliding surface 12*b* on which the piston 13 slides and which becomes high in temperature. Thus, the cylinder block 12I can be appropriately cooled. With this, the cooling performance of the cylinder block 12I can be improved, and the temperature increase of the sliding surface 12*b* can be suppressed. In addition, by the cooling groove 55 having the circular-arc shape, the operating oil for cooling can be discharged through the piston insertion end surface 12*c* toward the outer peripheral surface 12*a* of the cylinder block 12I. Therefore, forced flow of the operating oil is generated in the cooling groove 55, and this can improve the cooling effect.

CONCLUSION

As above, the cylinder blocks 12A to 12I can be adopted in accordance with specifications (such as the number of cylinder bores 20 of the hydraulic motor 10 (swash plate type liquid-pressure rotating apparatus 1) and the rotational frequency), conditions (such as usages), and the like. With this, the cylinder blocks 12A to 12I can be appropriately cooled. By appropriately cooling the cylinder blocks 12A to 12I, the temperature increase of the operating oil can be suppressed, and the lubrication performance of the operating oil can be prevented from deteriorating. Therefore, the swash plate type liquid-pressure rotating apparatus 1 and the like can be systematically and stably operated.

The above embodiments have explained cases where the hydraulic motor 10 is used as the swash plate type liquid-pressure rotating apparatus 1. However, the swash plate type liquid-pressure rotating apparatus 1 can be utilized as the other liquid-pressure apparatuses, such as hydraulic pumps. The liquid-pressure apparatus is not limited to the above embodiments.

Each of the above embodiments shows one example, and the embodiments may be combined with each other. Various modifications may be made within the scope of the present invention, and the present invention is not limited to the above embodiments.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the scope of the present invention.

REFERENCE SIGNS LIST

1 swash plate type liquid-pressure rotating apparatus
10 hydraulic motor
12A to 12I cylinder block
12*a* outer peripheral surface
12*b* sliding surface
12*c* piston insertion end surface
13 piston
17 casing
20 cylinder bore
50 cooling portion
51 cooling hole
52 drain hole portion
55 cooling groove
56 cutout portion
L1 axis
D diameter
H1, H2 axial depth
H3, H4 radial depth

The invention claimed is:

1. A cylinder block comprising:

a plurality of cylinder bores including respective openings formed on a piston insertion end surface of the cylinder block, a plurality of pistons being inserted in respective cylinder bores of the plurality of cylinder bores and being configured to reciprocate and slide in the respective cylinder bores of the plurality of cylinder bores when the cylinder block rotates; and a cooling portion including a plurality of cooling holes formed between adjacent cylinder bores of the plurality of cylinder bores and extending from the piston insertion end surface in an axial direction of the cylinder block, the plurality of cooling holes not extending to a side surface of the cylinder block, and an axial depth of each cooling hole of the plurality of cooling holes is within a range of depth from the piston insertion end surface to a deepest portion of the plurality of cylinder bores.

2. A swash plate type liquid-pressure rotating apparatus comprising the cylinder block according to claim 1, the swash plate type liquid-pressure rotating apparatus being connected to (i) a low-pressure passage configured to transfer a low-pressure operating liquid, and (ii) a high-pressure passage configured to transfer high-pressure operating oil, and the swash plate type liquid-pressure rotating apparatus being configured to:

rotate the cylinder block by supplying the low-pressure operating liquid through the high-pressure passage to the plurality of cylinder bores, and discharge the operating liquid from the plurality of cylinder bores to the low-pressure passage, or suction the low-pressure operating liquid through the low-pressure passage to the plurality of cylinder bores by rotating the cylinder block, compress the low-pressure operating liquid, and eject the low-pressure operating liquid to the high-pressure passage.

3. A cylinder block comprising:

a plurality of cylinder bores including respective openings formed on a piston insertion end surface of the cylinder block, a plurality of pistons being inserted in respective cylinder bores of the plurality of cylinder bores and being configured to reciprocate and slide in the respective cylinder bores when the cylinder block rotates; and a cooling portion including a plurality of cooling holes formed between adjacent cylinder bores of the plurality of cylinder bores and extending from the piston insertion end surface in an axial direction of the cylinder block, an axial depth of each cooling hole of the plurality of cooling holes being within a range of a depth from the piston insertion end surface to a deepest portion of the plurality of cylinder bores into which the plurality of piston are inserted, each cooling hole of the plurality of cooling holes being inclined so as to penetrate the cylinder block from the piston insertion end surface toward an outer peripheral surface of the cylinder block.

4. A swash plate type liquid-pressure rotating apparatus comprising the cylinder block according to claim 3, the swash plate type liquid-pressure rotating apparatus being connected to (i) a low-pressure passage configured to transfer a low-pressure operating liquid, and (ii) a high-pressure passage configured to transfer high-pressure operating oil, and the swash plate type liquid-pressure rotating apparatus being configured to:

rotate the cylinder block by supplying the low-pressure operating liquid through the high-pressure passage to the plurality of cylinder bores, and discharge the operating liquid from the plurality of cylinder bores to the low-pressure passage, or suction the low-pressure operating liquid through the low-pressure passage to the plurality of cylinder bores by rotating the cylinder block, compress the low-pressure operating liquid, and eject the low-pressure operating liquid to the high-pressure passage.

5. A cylinder block comprising:

a plurality of cylinder bores including a plurality of openings formed on a piston insertion end surface of the cylinder block, a plurality of pistons being inserted in respective cylinder bores of the plurality of cylinder bores and being configured to reciprocate and slide in the respective cylinder bores when the cylinder block rotates; and a cooling portion including a plurality of cooling holes formed between adjacent cylinder bores of the plurality of cylinder bores and extending from the piston insertion end surface in an axial direction of the cylinder block, an axial depth of each cooling hole of the plurality of cooling holes being within a range of a depth from the piston insertion end surface to a deepest portion of the plurality of cylinder bores into which the plurality of piston are inserted, each cooling hole of the plurality of cooling holes including:

a linear portion extending in parallel with the respective adjacent cylinder bores of the plurality of cylinder bores, and a drain hole portion extending from a position of the linear portion toward an outer peripheral surface of the cylinder block, the drain hole being open on the outer peripheral surface, the position of the linear portion being located away from the piston insertion end surface.

6. A swash plate type liquid-pressure rotating apparatus comprising the cylinder block according to claim 5, the swash plate type liquid-pressure rotating apparatus being connected to (i) a low-pressure passage configured to transfer a low-pressure operating liquid, and (ii) a high-pressure passage configured to transfer high-pressure operating oil, and the swash plate type liquid-pressure rotating apparatus being configured to:

rotate the cylinder block by supplying the low-pressure operating liquid through the high-pressure passage to the plurality of cylinder bores, and discharge the operating liquid from the plurality of cylinder bores to the low-pressure passage, or suction the low-pressure operating liquid through the low-pressure passage to the plurality of cylinder bores by rotating the cylinder block, compress the low-pressure operating liquid, and eject the low-pressure operating liquid to the high-pressure passage.

7. A cylinder block comprising:

a plurality of cylinder bores including a plurality of openings formed on a piston insertion end surface of the cylinder block, a plurality of pistons being inserted in respective cylinder bores of the plurality of cylinder bores and being configured to reciprocate and slide in the respective cylinder bores when the cylinder block rotates; and a cooling portion formed between adjacent bores of the plurality of cylinder bores, the cooling portion including a plurality of cooling holes extending in a radial direction from an outer peripheral surface of the cylinder block through a portion between the adjacent cylinder bores.

8. A swash plate type liquid-pressure rotating apparatus comprising the cylinder block according to claim 7, the swash plate type liquid-pressure rotating apparatus being connected to (i) a low-pressure passage configured to transfer a low-pressure operating liquid, and (ii) a high-pressure passage configured to transfer high-pressure operating oil, and the swash plate type liquid-pressure rotating apparatus being configured to:

rotate the cylinder block by supplying the low-pressure operating liquid through the high-pressure passage to the plurality of cylinder bores, and discharge the operating liquid from the plurality of cylinder bores to the low-pressure passage, or suction the low-pressure operating liquid through the low-pressure passage to the plurality of cylinder bores by rotating the cylinder block, compress the low-pressure operating liquid, and eject the low-pressure operating liquid to the high-pressure passage.

9. A cylinder block comprising:

a plurality of cylinder bores including a plurality of openings formed on a piston insertion end surface of the cylinder block, a plurality of pistons being inserted in respective cylinder bores of the plurality of cylinder bores and being configured to reciprocate and slide in the respective cylinder bores when the cylinder block rotates; and a cooling portion including a plurality of cooling holes extending in a radial direction from an outer peripheral surface of the cylinder block, the plurality of cooling holes not being in communication with the cylinder bores.

10. The cylinder block according to claim 9, wherein:

the plurality of cylinder bores include a plurality of insert bushings, and each cooling hole of the plurality of cooling holes extends from the outer peripheral surface of the cylinder block to an outer surface of a respective insert bushing of the plurality of insert bushings.

11. A swash plate type liquid-pressure rotating apparatus comprising the cylinder block according to claim 10, the swash plate type liquid-pressure rotating apparatus being connected to (i) a low-pressure passage configured to transfer a low-pressure operating liquid, and (ii) a high-pressure passage configured to transfer high-pressure operating oil, and the swash plate type liquid-pressure rotating apparatus being configured to:

rotate the cylinder block by supplying the low-pressure operating liquid through the high-pressure passage to the plurality of cylinder bores, and discharge the operating liquid from the plurality of cylinder bores to the low-pressure passage, or suction the low-pressure operating liquid through the low-pressure passage to the plurality of cylinder bores by rotating the cylinder block, compress the low-pressure operating liquid, and eject the low-pressure operating liquid to the high-pressure passage.

12. A swash plate type liquid-pressure rotating apparatus comprising the cylinder block according to claim 9, the swash plate type liquid-pressure rotating apparatus being connected to (i) a low-pressure passage configured to transfer a low-pressure operating liquid, and (ii) a high-pressure passage configured to transfer high-pressure operating oil, and the swash plate type liquid-pressure rotating apparatus being configured to:

rotate the cylinder block by supplying the low-pressure operating liquid through the high-pressure passage to the plurality of cylinder bores, and discharge the operating liquid from the plurality of cylinder bores to the low-pressure passage, or suction the low-pressure operating liquid through the low-pressure passage to the plurality of cylinder bores by rotating the cylinder block, compress the low-pressure operating liquid, and eject the low-pressure operating liquid to the high-pressure passage.

13. A cylinder block comprising:

a plurality of cylinder bores including a plurality of openings formed on a piston insertion end surface of the cylinder block, a plurality of pistons being inserted in respective cylinder bores of the plurality of cylinder bores and being configured to reciprocate and slide in the respective cylinder bores when the cylinder block rotates; and a cooling portion including:

an annular cutout portion formed at an edge portion of the piston insertion end surface of the cylinder block; and a plurality of cooling grooves formed on an outer peripheral surface of the cylinder block and extending from the annular cutout portion in an axial direction of the cylinder block such that the plurality of cooling grooves are formed at a radially opposite side of the plurality of cylinder bores from a radial center of the cylinder block.

14. A swash plate type liquid-pressure rotating apparatus comprising the cylinder block according to claim 13, the swash plate type liquid-pressure rotating apparatus being connected to (i) a low-pressure passage configured to transfer a low-pressure operating liquid, and (ii) a high-pressure passage configured to transfer high-pressure operating oil, and the swash plate type liquid-pressure rotating apparatus being configured to:

rotate the cylinder block by supplying the low-pressure operating liquid through the high-pressure passage to the plurality of cylinder bores, and discharge the operating liquid from the plurality of cylinder bores to the low-pressure passage, or suction the low-pressure operating liquid through the low-pressure passage to the plurality of cylinder bores by rotating the cylinder block, compress the low-pressure operating liquid, and eject the low-pressure operating liquid to the high-pressure passage.

15. A cylinder block comprising:

a plurality of cylinder bores including a plurality of openings formed on a piston insertion end surface of the cylinder block, a plurality of pistons being inserted in respective cylinder bores of the plurality of cylinder bores and being configured to reciprocate and slide in the respective cylinder bores when the cylinder block rotates; and a cooling portion formed between adjacent cylinder bores of the plurality of cylinder bores and including a plurality of cooling grooves, each cooling groove of the plurality of cooling grooves being formed between the adjacent cylinder bores so as to not radially overlap the respective cylinder bore of the plurality of cylinder bores, each cooling groove being formed on an outer peripheral surface of the cylinder block so as to extend from the piston insertion end surface in an axial direction of the cylinder block, and a radial depth of the cooling portion extending from the outer peripheral surface of the cylinder block through a portion between the adjacent cylinder bores to a position away from the axis of the cylinder block by a predetermined distance.

16. A swash plate type liquid-pressure rotating apparatus comprising the cylinder block according to claim 15, the swash plate type liquid-pressure rotating apparatus being connected to (i) a low-pressure passage configured to transfer a low-pressure operating liquid, and (ii) a high-pressure passage configured to transfer high-pressure operating oil, and the swash plate type liquid-pressure rotating apparatus being configured to:

rotate the cylinder block by supplying the low-pressure operating liquid through the high-pressure passage to the plurality of cylinder bores, and discharge the operating liquid from the plurality of cylinder bores to the low-pressure passage, or suction the low-pressure operating liquid through the low-pressure passage to the plurality of cylinder bores by rotating the cylinder block, compress the low-pressure operating liquid, and eject the low-pressure operating liquid to the high-pressure passage.

* * * * *